United States Patent [19]

Miller

[11] Patent Number: 4,927,193

[45] Date of Patent: May 22, 1990

[54] MOUNTING CASSETTE FOR PUSH-BAR EXIT DEVICES

[75] Inventor: Theodore H. Miller, New Britain, Conn.

[73] Assignee: Emhart Industries, Inc., Farmington, Conn.

[21] Appl. No.: 868,851

[22] Filed: May 30, 1986

[51] Int. Cl.[5] ..... F05C 3/12

[52] U.S. Cl. ..... 292/92; 292/142

[58] Field of Search ..... 292/51, 21, 112, 142, 292/160, 172, 199, 336.3, 92

[56] References Cited

U.S. PATENT DOCUMENTS

| | | | |
|---|---|---|---|
| 3,175,376 | 3/1965 | Cantwell | 292/142 X |
| 3,877,262 | 4/1975 | Williams | 292/92 X |
| 3,991,595 | 11/1976 | Bahry et al. | 292/142 X |
| 4,058,333 | 11/1977 | Roe et al. | 292/142 X |
| 4,239,268 | 12/1980 | Rider | 292/199 X |
| 4,295,673 | 10/1981 | Miller | 292/21 |
| 4,384,465 | 5/1983 | Muus | 292/172 X |
| 4,502,716 | 3/1985 | Yu | 292/142 |
| 4,524,590 | 6/1985 | Budish | 292/142 X |
| 4,583,381 | 4/1986 | Sjogren | 292/142 X |

FOREIGN PATENT DOCUMENTS

| | | | |
|---|---|---|---|
| 1024803 | 1/1953 | France | 292/51 |
| 2436239 | 5/1980 | France | 292/142 |
| 701693 | 3/1966 | Italy | 292/142 |

*Primary Examiner*—Eric K. Nicholson

*Attorney, Agent, or Firm*—Barry E. Deutsch

[57] ABSTRACT

A mounting cassette for an exit device includes a latch bolt assembly. Latch bolt assembly includes a rotatable member for causing retraction of the latch of said assembly. The cassette is used to mount the exit device on a first side of a door having on the opposite side thereof a cylinder lock. The cylinder lock includes an actuator member extending through the door. The mounting cassette has first motion transmitting member mounted for rotation therein. The first motion transmitting member receives the actuating member for rotation thereby. Second motion transmitting member is rotatably coupled with the first motion transmitting member and is connected to the rotatable member of the latch bolt assembly.

6 Claims, 4 Drawing Sheets

MOUNTING CASSETTE FOR PUSH-BAR EXIT DEVICES

BACKGROUND OF THE INVENTION

This invention relates to a mounting cassette for a latch bolt assembly for a push-bar exit device, and more particularly to a mounting cassette for an exit device particularly useful on narrow stile doors.

Aluminum door manufacturers produce doors of various stile widths. Additionally, an increasing number of doors are used with glass panels having a raised molding enclosing the glass. In both cases, some of the stiles are fairly narrow. In the case of narrow stiles, a conventional or standard exit device cannot be used with a cylinder lock due to the fact that the tail piece extending from the cylinder lock mounted in the stile of the door will not align with the locking mechanism of the latch bolt assembly of the exit device. In particular, the tail piece of the cylinder lock extends through the vertical axis of the stile, whereas the mating member of the locking mechanism is positioned laterally inwardly towards the center of the door with respect to the vertical axis of the stile. Heretofore, special exit devices have been developed for use with narrow stile doors. The cost of maintaining separate inventories of standard and special exit devices is relatively expensive, and in addition, increases the manufacturing cost of each of the types of exit devices. In view of the foregoing, it is broadly an object of the present invention to mount a standard exit device on a narrow stile door through the use of novel mounting means.

SUMMARY OF THE INVENTION

The foregoing object and other objects of the invention are attained in a mounting cassette for an exit device including a latch bolt assembly including a rotatable member for causing retraction of the latch of said assembly, said cassette mounting the exit device on a first side of a door having on the opposite side thereof a cylinder lock, said cylinder lock including an actuator member extending through the door, said cassette having first motion transmitting member mounted for rotation therein and receiving the actuating member for rotation thereby, a second motion transmitting member is rotatably coupled with the first motion transmitting member and includes an actuator blade extending therefrom into engagement with the rotatable member of the latch bolt assembly.

DESCRIPTION OF THE PREFERRED EMBODIMENT

Figure 1:
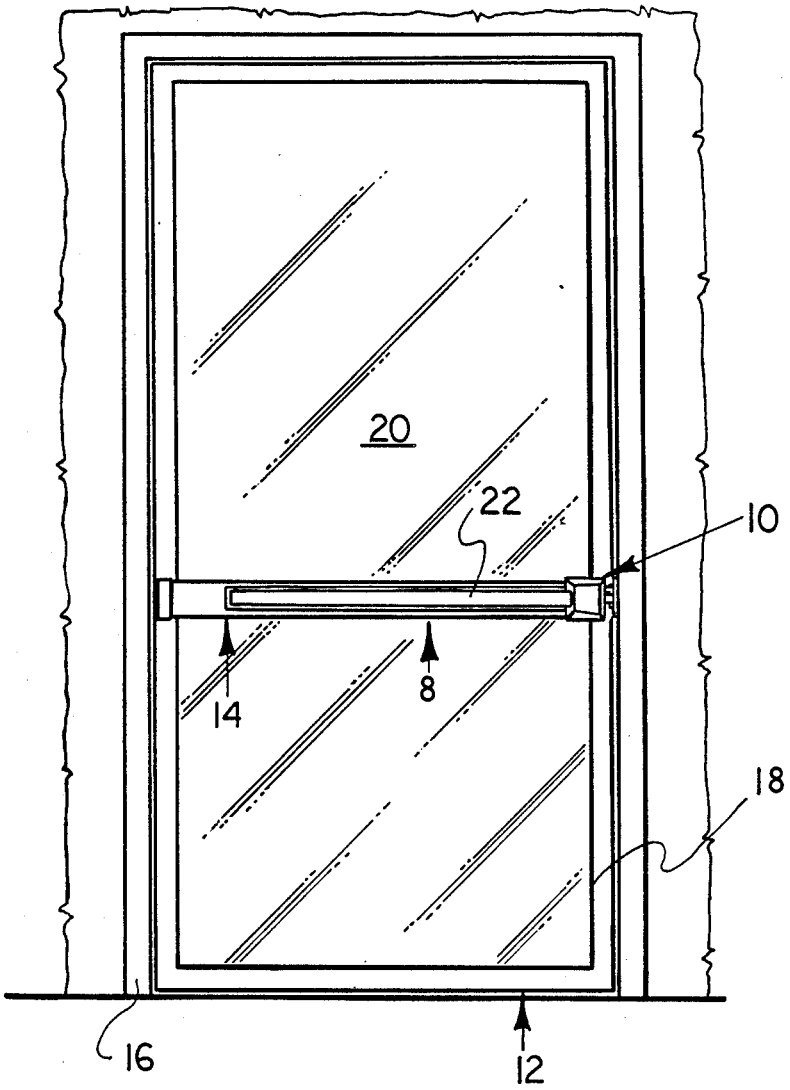
FIG. 1 is an elevational view of the active or inner side of a door having an exit device mounting thereon.
Figure 2:
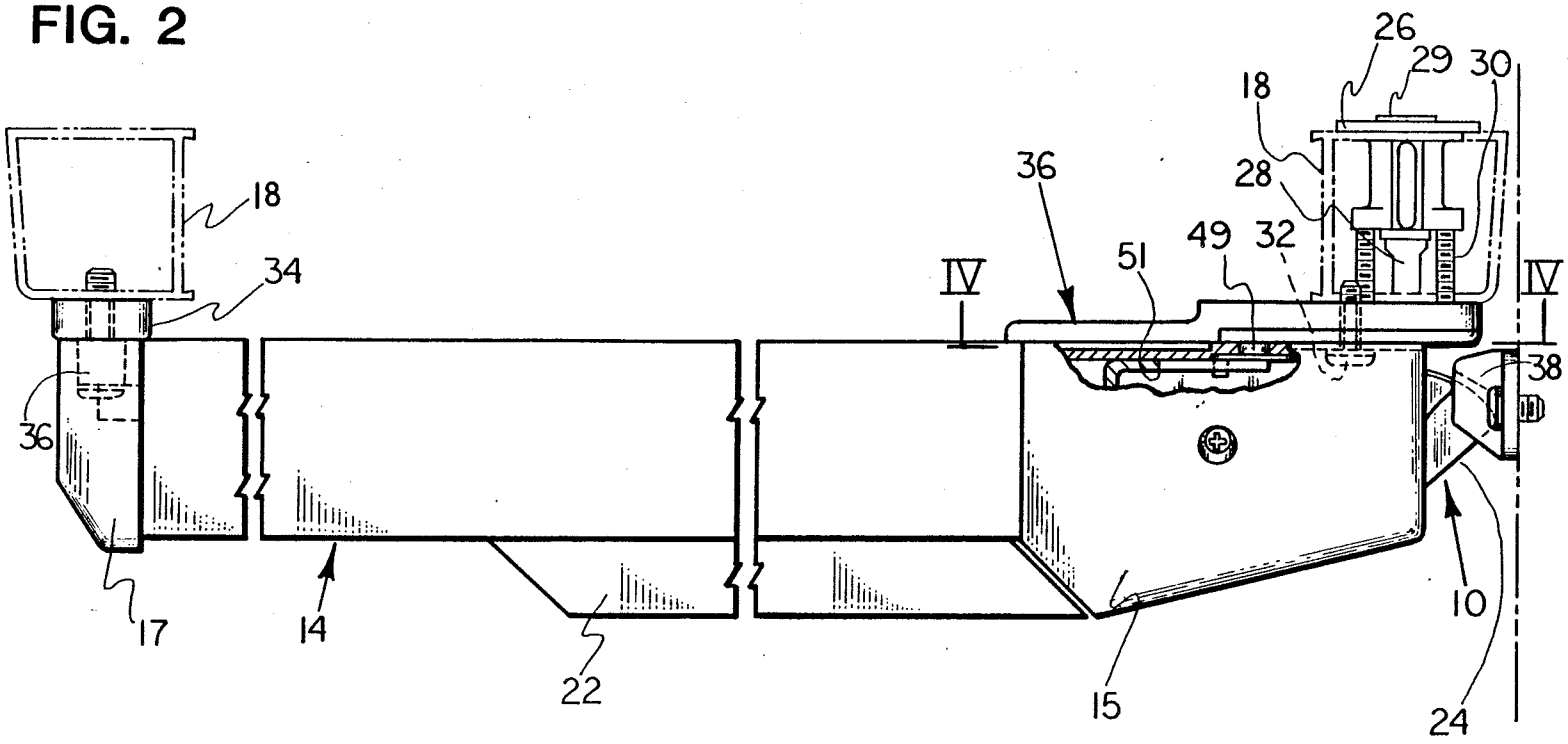
FIG. 2 is a plan view, partially in section, illustrating an exit device mounted on a door.
Figure 3:
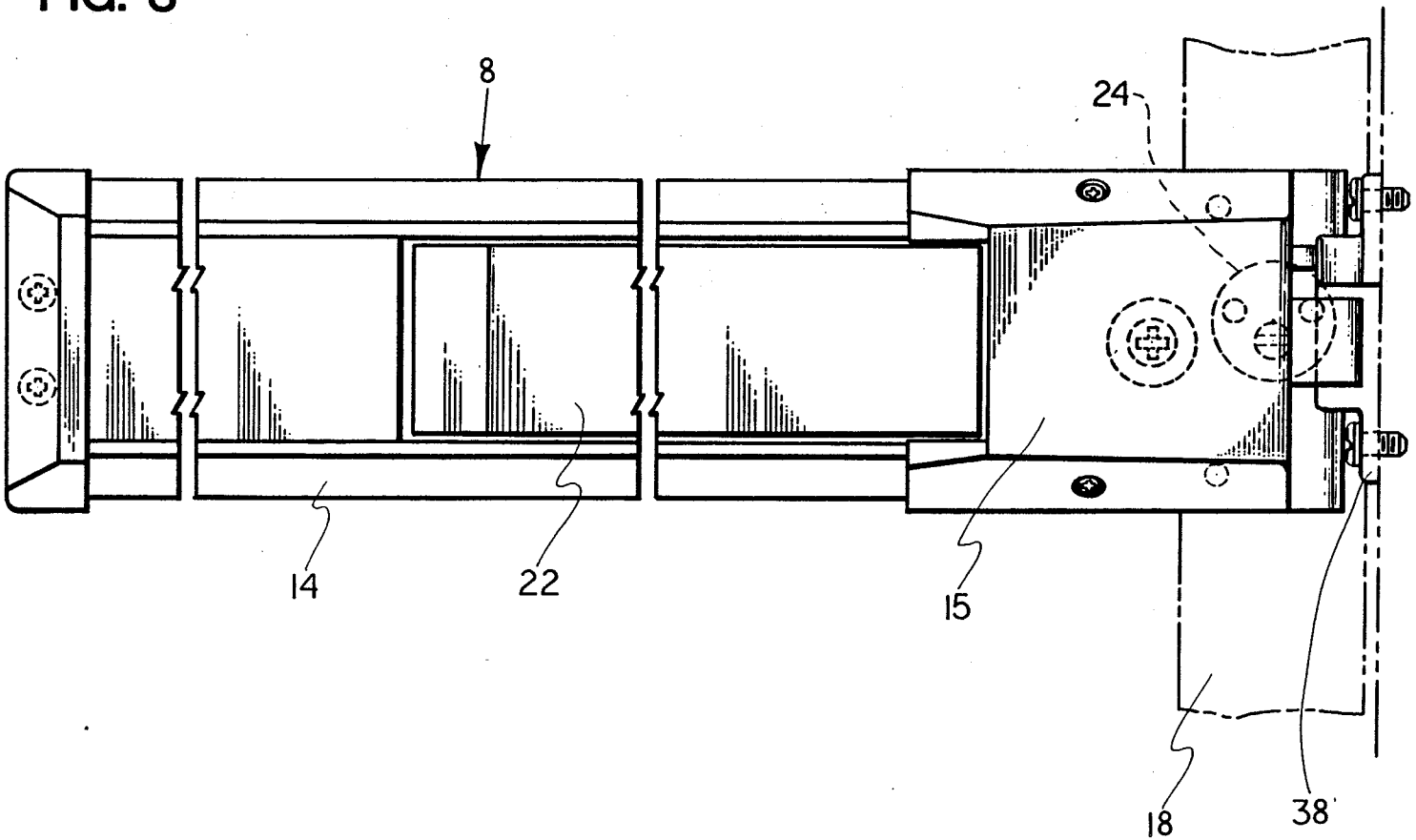
FIG. 3 is an enlarged elevational view of the exit device mounted on a door.

Referring now to the drawing, and more particularly to FIGS. 1-3, an exit device 8 to be used with the present invention includes a latch bolt assembly 10 contained within latch bolt housing 14. Housing 14 includes a front cover 15, a rear cover 17 and an intermediate cover 14. Exit device 8 is of a rim or surface mounted type and as illustrated is mounted on one surface of a door 12. Door 12 is installed within door frame 16. In the preferred embodiment, door 12 includes a relatively narrow width stile 18 functioning as a frame for glass window 20.

Exit device 8 comprises a latch bolt mechanism designated generally by reference numeral 10 which includes a latch bolt 24 and an actuating mechanism which includes an elongated actuating member or pushbar 22. Pushbar 22 is mounted in a horizontal position on the door to span a substantial portion of the door width and is operable at all times. The length of pushbar 22 is generally coextensive with the length of cover 14. A slight pressure on the pushbar will instantly retract the latch bolt to release it from engagement with strike assembly 38 to release door 12 and allow immediate egress. Exit device 8 may be of the type illustrated in U.S. patent application Ser. No. 535,509 filed Sept. 26, 1983 now U.S. Pat. No. 4,624,490 in the name of Theodore H. Miller, which application is incorporated herein by reference. Additionally, the latch bolt mechanism, particularly the actuating mechanism for latch bolt 24, may be of the type disclosed in U.S. Pat. No. 3,877,262 issued Apr. 15, 1975 to Merton S. Williams, which patent is also incorporated herein by reference.

As illustrated particularly in FIG. 2, exit device 8 includes a cylinder lock 26 disposed in stile 18 on the side of the door opposite pushbar 22. Cylinder lock 26 includes tail piece 28 connected to rotatable plug 29 of the lock for rotation therewith. Tail piece 28, in-turn, actuates latch bolt assembly 10. Screws 30 or similar devices are used to attach the cylinder lock within stile 18.

A mounting cassette 36, to be more fully described hereinafter, is disposed between the rear face of front cover 15 and the confronting face of door 12. Mounting cassette 36 is joined to stile 18 via screws 32 or similar devices. To accommodate the use of mounting cassette 36, a spacer member 34 is disposed between the rear face of rear cover 17 and the confronting face of stile 18. A screw 36 or similar device is used to attach spacer 34 to stile 18.

When exit devices of the type disclosed are used on standard width stiles, the tail piece 28 of cylinder lock 26 aligns with the operating mechanism for latch bolt assembly 10. However, with relatively narrow width stiles, it has not heretofore been possible to align tail piece 28 with the latch bolt operating mechanism, and thus, special exit devices have heretofore been sold solely for use on narrow width stile doors. As will be immediately appreciated when referring to FIG. 5 of the drawing, tail piece 28 intersects the vertical axis of stile 18, while actuator mechanism 48 used to retract latch 24 is positioned laterally inwardly towards the center of door 12. As is evident, to decrease manufacturing and inventory costs, it is desirable to use a single exit device on either a narrow or standard width stile door.

Figure 4:
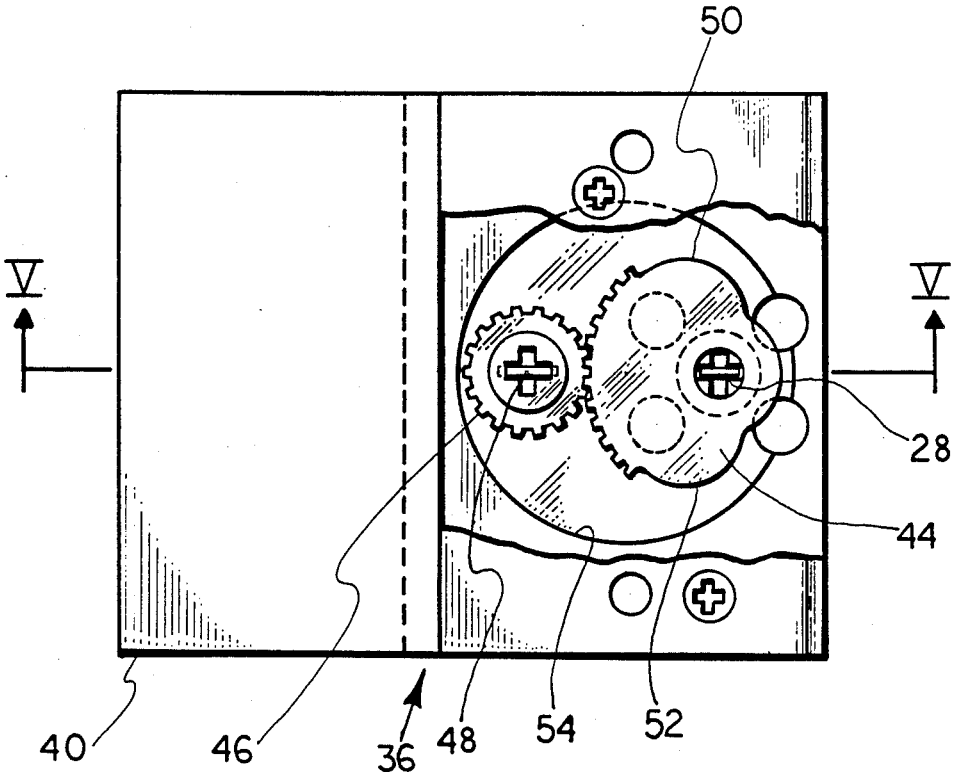
FIG. 4 is a view taken along line IV—IV of FIG. 2 showing the mounting device partially in section.
Figure 5:
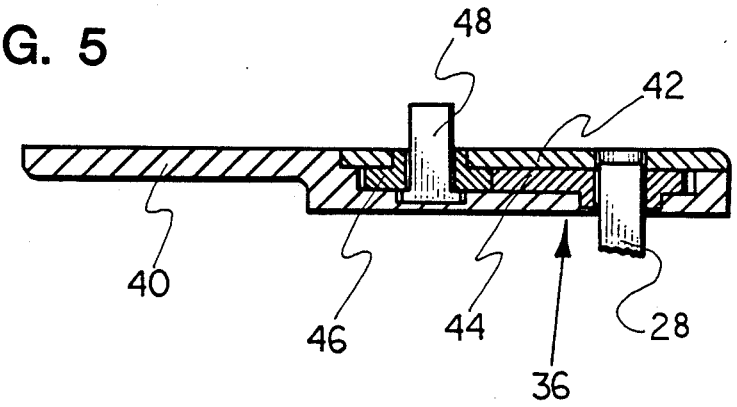
FIG. 5 is a view taken along line V—V of FIG. 4.

As noted previously, mounting cassette 36 is interposed between the rear face of cover 15 and the confronting face of door 12. As illustrated in FIGS. 4 and 5, mounting cassette 36 includes a main housing member 40. Housing member 40 includes a bore 54. A second housing member 42 overlies bore 54. A first motion transmitting member 44 is rotatably mounted within bore 54. First motion transmitting member 44 is illustrated as a gear sector. Further, a second motion transmitting member 46 is rotatably mounted within a bore 54. In the preferred embodiment, second motion transmitting member 46 is illustrated as a pinion having teeth in driven engagement with the teeth of gear sector 44. Tail piece 28 of cylinder lock 26 is rotatably coupled to gear sector 44. Rotatable actuator mechanism 48 is coupled to pinion 46; mechanism 48 functions to retract latch 24 upon its rotation. Gear sector 44 includes shoulder portions 50 and 52 disposed on either side of the gear teeth. When section 44 is rotated in a clockwise direction, shoulder 52 will contact the wall of bore 54 to limit rotational movement of the sector. Similarly, contact between shoulder 50 and the wall of the bore will limit rotation in a counter-clockwise direction.

In operation, rotation of plug 29 of cylinder lock 26 results in concurrent rotation of tail piece 28. Rotation of the tail piece rotates gear sector 44 which in turn transmits the rotatable motion to pinion 46. Rotation of the pinion results in rotation of member 48 which, in turn, results in movement of a latch bolt 24.

When exit devices of the type disclosed are used on standard width stile doors, tail piece 28 is directly coupled to operating member 48 whereby rotation of the tail piece directly results in movement of the latch bolt.

By employing the mounting cassette of the present invention, standard exit devices of the type disclosed may be used on narrow width stile doors as well as standard width stile doors.

While a preferred embodiment of the present invention has been described and illustrated, the invention should not be limited thereto but may be otherwise embodied within the scope of the following claims.

I claim:

1. A mounting cassette for an exit device mounted on a first side of a narrow stile door and having a cylinder lock mounted on the other side of said door, said exit device, and said cylinder lock being selectively operable to control movement of a latch bolt of a latch bolt assemble, said exit device having a first actuator connected to said latch bolt and said cylinder lock having a second actuator connected to the latch bolt, the longitudinal axis of said second actuator extending through the narrow stile and the longitudinal axis of said first actuator being inwardly offset along the horizontal axis of the door relative to the longitudinal axis of said second actuator, said mounting cassette including first motion transmitting means mounted for rotation in said cassette and including coupling means for receiving said second actuator for rotation of said motion transmitting means thereby;

second motion transmitting means rotatably coupled with said first motion transmitting means for receiving said first actuator, with the longitudinal axis of said second motion transmitting means being inwardly offset along the horizontal axis of the door relative to the longitudinal axis of said first motion transmitting means.

2. Locking assembly for a narrow stile door including an exit device mounted on a first side of the door and having a cylinder lock mounted on the other side of said door, said exit device and said cylinder lock being selectively operable to control movement of a latch bolt assembly, said exit device having a first actuator connected to said latch bolt and said cylinder lock having a second actuator connected to the latch bolt, the longitudinal axis of said second actuator extending through the narrow stile and the longitudinal axis of said first actuator being inwardly offset along the horizontal axis of the door relative to the longitudinal axis of said second actuator, and a mounting cassette interposed between the exit device and the first side of the door comprising first motion transmitting means mounted for rotation in the housing of said cassette and including coupling means for receiving said second actuator for rotation of said motion transmitting means thereby; and second motion transmitting means rotatably coupled with said first motion transmitting means for receiving said first actuator, the longitudinal axis of said second motion transmitting means being inwardly offset along the horizontal axis of the door relative to the longitudinal axis of said first motion transmitting means.

3. A locking assembly in accordance with claim 2 wherein the first motion transmitting means is a gear sector and said second motion transmitting means is a pinion.

4. A mounting cassette in accordance with claim 3 wherein the gear sector includes first and second stop members circumferentially positioned on either side of the gear teeth of said sector for limiting rotational movement of the sector in clockwise or counterclockwise directions.

5. A mounting cassette in accordance with claim 1 wherein the first motion transmitting means is a gear sector and said second motion transmitting means is a pinion.

6. A mounting cassette in accordance with claim 5 wherein the gear sector includes first and second stop members circumferentially positioned on either side of the gear teeth of said sector for limiting rotational movement of the said sector in either clockwise or counter-clockwise directions.

* * * * *